United States Patent [19]

Marais

[11] Patent Number: 4,520,886

[45] Date of Patent: Jun. 4, 1985

[54] ROTARY DRILLING TOOL WITH PERCUSSION DEVICE

[75] Inventor: Lionel Marais, Paris, France

[73] Assignee: Compagnie Francaise des Petroles, Paris, France

[21] Appl. No.: 511,357

[22] Filed: Jul. 6, 1983

[30] Foreign Application Priority Data

Jul. 7, 1982 [FR] France ..... 82 11980

[51] Int. Cl.[3] ..... E21B 4/14

[52] U.S. Cl. ..... 173/135; 173/73; 91/50

[58] Field of Search ..... 173/135, 73, 136, 134; 91/50, 51, 234

[56] References Cited

U.S. PATENT DOCUMENTS

| | | | |
|---|---|---|---|
| 2,422,031 | 6/1947 | Merten | 91/50 |
| 3,970,152 | 7/1976 | Harris et al. | 173/73 X |
| 4,221,157 | 9/1980 | Schmidt | 173/135 X |
| 4,275,794 | 6/1981 | Carbonaro | 173/135 |
| 4,284,147 | 8/1981 | Jenne | 91/234 X |
| 4,402,370 | 9/1983 | Gein et al. | 91/234 X |

FOREIGN PATENT DOCUMENTS

| | | | |
|---|---|---|---|
| 709893 | 6/1954 | United Kingdom | 91/234 |

*Primary Examiner*—E. R. Kazenske
*Assistant Examiner*—Willmon Fridie, Jr.
*Attorney, Agent, or Firm*—Sughrue, Mion, Zinn, Macpeak and Seas

[57] ABSTRACT

A hollow rotary drilling tool is equipped with a percussion device which comprises a nozzle comprising a cylindrical annular duct followed by a divergent annular duct. The divergent duct opens into flow paths, a central path and a peripheral path, through which drilling mud flows alternately in order to cause reciprocation of a percussion head located in the central path. The peripheral path joins the central path downstream of the percussion head. The external conical surface of the divergent duct is connected to the external cylindrical surface of the cylindrical duct via a radial step, which makes the flow in the peripheral path unstable, so that under normal conditions of flow the drilling mud flows along the central path. Flow along the central path is interrupted by contact of the percussion head with an abutment, which limits its movement in one direction, and which closes the central path, causing flow to switch to the peripheral path. This causes the percussion head to lift, opening the central path so that flow switches back to the central path.

6 Claims, 1 Drawing Figure

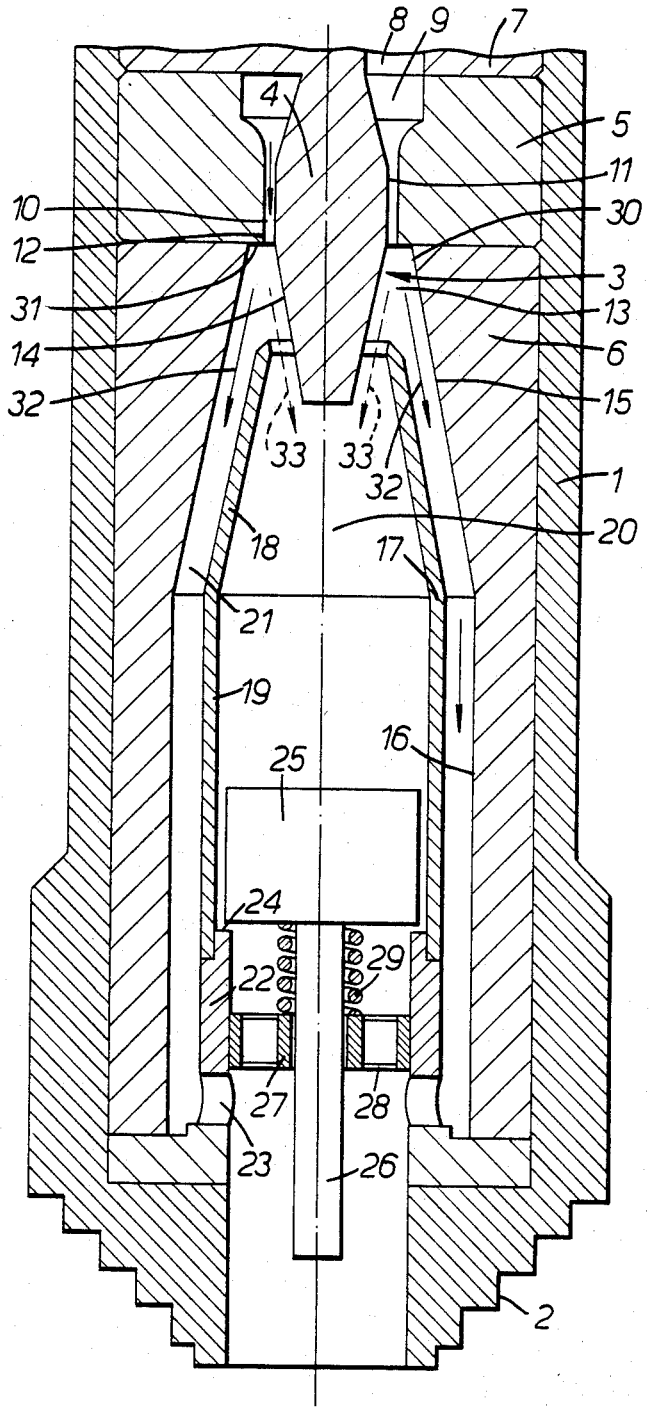
8
9
7
4
5
11
10
30
12
3
31
13
14
6
32
15
33
33
32
1
20
18
17
21
19
16
25
24
29
22
27
28
23
26
2

ROTARY DRILLING TOOL WITH PERCUSSION DEVICE

BACKGROUND OF THE INVENTION

The invention relates to a rotary drilling tool whose speed of penetration into hard ground is improved by the addition of a percussion device.

A tool of this type has already been proposed in commonly assigned U.S. Pat. No. 4,275,794. However the percussion device disclosed has the disadvantage that it is complex in construction.

SUMMARY OF THE INVENTION

According to the invention there is provided a rotary drilling tool including a percussion device which comprises;

an annular nozzle comprising, from upstream to downstream, an annular inlet neck in communication with an upstream passage for the introduction of drilling mud, a cylindrical annular duct provided between an internal cylindrical surface and an external cylindrical surface, and a divergent annular duct provided between an internal convergent conical surface and an external divergent conical surface;

a hollow part with an upstream portion of divergent conical shape projecting into said divergent annular duct and dividing it into a central flow path and a peripheral flow path, and a downstream portion of cylindrical shape;

a percussion head located in said downstream portion of said hollow part and forming a piston therein; and an abutment capable of stopping said percussion head in the downstream direction, said central flow path being at least partially closed when said percussion head abuts said abutment;

wherein, at its upstream end, said external divergent conical surface has a larger diameter than said external cylindrical surface, said external cylindrical surface being connected to said external divergent conical surface by a radial step, which makes flow along said peripheral flow path unstable and tends to restore flow automatically into said central flow path.

The diameter difference indicated above, from which the said radial step results, is preferably greater than 2 mm.

BRIEF DESCRIPTION OF THE DRAWINGS

An embodiment of a drilling tool will now be described, by way of example only, with reference to the accompanying drawing, wherein the single FIGURE shows an axial section of the active part of a drilling tool in accordance with the invention.

DETAILED DESCRIPTION OF THE PREFERRED EMBODIMENT

As shown in the drawing, the drilling tool 1, which is caused to rotate by any suitable means, for example a string of rods or a turbine, which is not shown, has stepped cutting elements 2 on the outside, in its lower part. The tool is hollow with an opening at its lower end, and the hollow interior of the tool 1 serves to accommodate a percussion device, the various elements of which will be described hereafter. The tool may alternatively be a conventional tool, such as a three-cone bit, to which a percussion device is screwed.

The percussion device comprises a nozzle 3 defined between a solid internal part 4 located at the centre of the tool and annular parts 5 and 6 surrounding the part 4. The solid internal part 4 is carried by a thick disc 7, located upstream, only a portion of which is shown, and in which at least one passage 8 for the introduction of drilling mud is provided. Formed between the parts 4 and 5 are an annular inlet neck 9 into which the passage 8 opens, and a cylindrical annular duct 10, provided between an internal cylindrical surface 11 of the part 4 and an external cylindrical surface 12 of the part 5, which runs from the neck 9 to a divergent annular duct 13. The divergent annular duct 13 is provided between an internal convergent conical surface 14 of the part 4 and an external divergent conical surface 15 of the part 6.

Downstream of the divergent surface 15, the part 6 has a cylindrical surface 16. Located inside the part 6, there is an open ended hollow part 17 of which an upstream portion 18 has a divergent conical shape corresponding to the surface 15, while the downstream portion 19 has a cylindrical shape, the transition between the portions 18 and 19 taking place approximately at the same level as the transition between the surfaces 15 and 16.

The upstream portion 18 projects into the duct 13 and defines a central flow path 20 inside the part 17 and a peripheral flow path 21 between the part 17 and the surfaces 15 and 16 of the part 6. The part 17 is carried by a part 22 which extends in the downstream direction and in which orifices 23 are provided which enable the peripheral flow path 21 to rejoin the central flow path 22 downstream of an abutment 24 formed by a shoulder on the part 22.

A percussion head 25 is arranged in the central flow path 20 and is slidable, with considerable clearance, inside the portion 19 of the hollow part 17. Head 25 is guided by a rod 26 which slides over the internal cylindrical surface of a ring 27 carried by a perforated spacer 28 fitted to the part 22. The external diameter of the percussion head 25 is greater than the internal diameter of the abutment 24. A compression spring 29 is inserted between the percussion head and the spacer 28. The head 25 forms a piston in portion 19 of part 17 and in operation movement of head 25 in the downstream direction is limited by abutment with abutment 24.

At its upstream end 30, the external divergent conical surface 15 has a diameter which is larger, preferably at least 2 mm larger and for example about 4 mm larger, than that of the external cylindrical surface 12, so that neither of these two surfaces lies along the extension of the other and so that they are connected to one another via a small step 31 consisting of a radial surface of the part 5. This small step 31 makes the flow of drilling mud unstable in the peripheral flow path 21 in the direction of the arrows 32, while the central flow path 20, which has the advantage of the Coanda effect along the conical surface 14, is the normal flow path for the drilling mud. If an over-pressure is created at the inlet of the central flow path 20, the drilling mud is forced thereby to follow in the direction of the arrows 32 along the peripheral flow path 21. As soon as the overpressure is relieved, the drilling mud automatically returns to path 20 and flows in the direction of the arrows 33.

The over-pressure is created by the arrival of the percussion head 25 on the abutment 24, which at least partially blocks the central flow path 20. The consequent passage of the drilling mud into the peripheral flow path 21, and then into the orifices 23, establishes a fluid pressure downstream of the percussion head 25, causing the head to rise and opening the central flow path 20 again, which causes the flow of drilling mud to return to the central flow path. The percussion head 25 then falls again and strikes the abutment 24, and the cycle recommences. The spring 29 helps the percussion head 25 to rise, but it is not always necessary.

An examination of the FIGURE makes it possible to appreciate the simplicity of the construction shown, but numerous modifications can be applied thereto without exceeding the scope of the invention.

What is claimed is:

1. A rotary drilling tool including a percussion device which comprises;

an annular nozzle (3) comprising, continuously and without interruption from upstream to downstream, a first annular element (5) defining an annular inlet neck (9) in communication with an upstream passage (8) for the introduction of drilling mud, a cylindrical annular duct (10) provided between an internal cylindrical surface (11) and an external cylindrical surface (12), and a second annular element (6) defining a divergent annular duct (13) provided between an internal convergent conical surface (14) and an external divergent conical surface (15);

a hollow part (17) with an upstream portion (18) of divergent conical shape projecting into said divergent annular duct and dividing it into a central flow path (20) and a peripheral flow path (21), and a downstream portion (19) of cylindrical shape;

a percussion head (25) located in said downstream portion of said hollow part and forming a piston therein; and an abutment (24) capable of stopping said percussion head in the downstream direction, said central flow path being at least partially closed when said percussion head abuts said abutment;

wherein, at an upstream end said external divergent conical surface directly adjoining the cylindrical annular duct, said external divergent conical surface (15) has a larger diameter than said external cylindrical surface (12), said first and second annular elements being in direct contact and said external cylindrical surface being directly connected to said external divergent conical surface to define an abrupt and turbulence generating radial step (31), which makes flow along said peripheral flow path unstable and tends to restore flow automatically into said central flow path.

2. A drilling tool according to claim 1, wherein the diameter difference, from which said radial step results, is greater than 2 mm.

3. A drilling tool according to claim 1, wherein said tool is hollow and said percussion device is provided within said hollow.

4. A drilling tool according to claim 3, wherein said percussion device comprises annular parts providing said external surfaces of said cylindrical and divergent annular ducts and externally defining said peripheral flow path and a solid part providing said internal surfaces of said cylindrical and divergent annular ducts.

5. A drilling tool according to claim 1, wherein downstream of said abutment said peripheral flow path joins up with said central flow path.

6. A drilling tool according to claim 4, wherein said abutment is provided at the downstream end of said hollow part and, downstream of said abutment, apertures (23) are provided in said hollow part through which fluid in said peripheral flow path flows into said central flow path downstream of said percussion head for causing said percussion head to lift from abutment with said abutment.

* * * * *